US008074892B2

(12) United States Patent
Bracken et al.

(10) Patent No.: US 8,074,892 B2
(45) **Date of Patent: *Dec. 13, 2011**

(54) APPLIANCE CONTROL WITH AUTOMATIC DAMPER DETECTION

(75) Inventors: Scott J. Bracken, Long Lake, MN (US); Brent Chian, Plymouth, MN (US); Timothy J. Nordberg, Plymouth, MN (US); Henry E. Troost, River Falls, WI (US)

(73) Assignee: Honeywell International Inc., Morristown, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/729,778

(22) Filed: Mar. 23, 2010

(65) Prior Publication Data

US 2010/0173252 A1 Jul. 8, 2010

Related U.S. Application Data

(63) Continuation of application No. 11/276,121, filed on Feb. 15, 2006, now Pat. No. 7,721,972, which is a continuation-in-part of application No. 11/306,875, filed on Jan. 13, 2006, now Pat. No. 7,747,358.

(51) Int. Cl.
*F23N 5/00* (2006.01)

(52) U.S. Cl. ..... 236/1 H; 236/11; 236/15 R; 236/21 R; 236/46 E

(58) Field of Classification Search ..... 236/1 H, 236/10, 11, 15 R, 20 R, 21 R, 46 E
See application file for complete search history.

(56) References Cited

U.S. PATENT DOCUMENTS

| | | | |
|---|---|---|---|
| 3,847,350 | A | 11/1974 | Thompson |
| 3,849,350 | A | 11/1974 | Matsko |
| 4,204,833 | A | 5/1980 | Kmetz et al. |
| 4,256,257 | A | 3/1981 | Pinkerton |
| 4,267,965 | A | 5/1981 | Everett |
| 4,299,554 | A | 11/1981 | Williams |
| 4,324,944 | A | 4/1982 | Wiehrich et al. |
| RE30,936 | E | 5/1982 | Kmetz et al. |
| 4,333,002 | A | 6/1982 | Kozak |
| 4,460,329 | A | 7/1984 | Trent |
| 4,508,261 | A | 4/1985 | Blank |

(Continued)

FOREIGN PATENT DOCUMENTS

EP 0356609 3/1990

(Continued)

OTHER PUBLICATIONS

U.S. Appl. No. 10/911,151, filed Aug. 3, 2004.

(Continued)

*Primary Examiner* — Marc Norman
(74) *Attorney, Agent, or Firm* — Seager, Tufte & Wickhem LLC

(57) ABSTRACT

Methods and systems for operating a fuel fired appliance that may include an optional hardware component such as a damper are disclosed. In some cases, the presence of the optional hardware component is detected, and it is determined whether the optional hardware component is required for future operation of the fuel fired appliance. The fuel fired appliance may be operated normally if the optional hardware component is present and required, or, in some cases, if the optional hardware component is determined to be not required. If the optional hardware component is absent but required, normal operation of the fuel fired appliance may be stopped.

20 Claims, 8 Drawing Sheets

U.S. PATENT DOCUMENTS

| | | | |
|---|---|---|---|
| 4,511,790 | A | 4/1985 | Kozak |
| 4,538,980 | A | 9/1985 | Hoyme |
| 4,588,875 | A | 5/1986 | Kozak et al. |
| 4,692,598 | A | 9/1987 | Yoshida et al. |
| 4,696,639 | A | 9/1987 | Bohan, Jr. |
| 4,734,658 | A | 3/1988 | Bohan, Jr. |
| 4,742,210 | A | 5/1988 | Tsuchiyama et al. |
| 4,752,210 | A | 6/1988 | Trent |
| 4,770,629 | A | 9/1988 | Bohan, Jr. |
| 4,834,284 | A | 5/1989 | Vandermeyden |
| 4,835,670 | A | 5/1989 | Adams et al. |
| 4,880,376 | A | 11/1989 | Bartels et al. |
| 4,984,981 | A | 1/1991 | Pottebaum |
| 4,986,468 | A | 1/1991 | Deisinger |
| 5,007,156 | A | 4/1991 | Hurtgen |
| 5,039,006 | A | 8/1991 | Habegger |
| 5,276,630 | A | 1/1994 | Baldwin et al. |
| 5,442,157 | A | 8/1995 | Jackson |
| 5,622,200 | A | 4/1997 | Schulze |
| 5,660,328 | A | 8/1997 | Momber |
| 5,797,358 | A | 8/1998 | Brandt et al. |
| 5,896,089 | A | 4/1999 | Bowles |
| 5,968,393 | A | 10/1999 | Demaline |
| 5,975,884 | A | 11/1999 | Dugger |
| 6,048,193 | A | 4/2000 | Juntunen et al. |
| 6,053,130 | A | 4/2000 | Shellenberger |
| 6,059,195 | A | 5/2000 | Adams et al. |
| 6,208,806 | B1 | 3/2001 | Langford |
| 6,261,087 | B1 | 7/2001 | Bird et al. |
| 6,271,505 | B1 | 8/2001 | Henderson |
| 6,293,471 | B1 | 9/2001 | Stettin et al. |
| 6,350,967 | B1 | 2/2002 | Scott |
| RE37,745 | E | 6/2002 | Brandt et al. |
| 6,560,409 | B2 | 5/2003 | Troost, IV |
| 6,701,874 | B1 | 3/2004 | Schultz et al. |
| 6,955,301 | B2 | 10/2005 | Munsterhuis et al. |
| 6,959,876 | B2 | 11/2005 | Chian et al. |
| 7,205,892 | B2 | 4/2007 | Luebke et al. |
| 7,221,862 | B1 | 5/2007 | Miller et al. |
| 2001/0025349 | A1 | 9/2001 | Sharood et al. |
| 2001/0031138 | A1 | 10/2001 | Troost, IV |
| 2002/0132202 | A1 | 9/2002 | Clifford |
| 2004/0176859 | A1 | 9/2004 | Chian et al. |
| 2004/0185770 | A1 | 9/2004 | Soeholm et al. |
| 2005/0077368 | A1 | 4/2005 | Zak et al. |
| 2005/0161516 | A1 | 7/2005 | Munsterhuis |
| 2006/0214015 | A1 | 9/2006 | Furukawa et al. |
| 2007/0023333 | A1 | 2/2007 | Mouhebaty et al. |

FOREIGN PATENT DOCUMENTS

| | | |
|---|---|---|
| EP | 0356609 | 3/2006 |
| GB | 2211331 | 6/1989 |

OTHER PUBLICATIONS

Honeywell D896 Automatic Vent Damper, Product Data, 12 pages, 1997.

Honeywell S8610U Universal Intermittent Pilot Module, Installation Instructions, 20 pages, Aug. 1996.

Johnson Controls Q135 Automatic Flue Damper System, 8 pages, 1998.

Lennox, "Network Control Panel (NCP), User's Manual," 18 pages, Nov. 1999.

U.S. Appl. No. 10/911,151, entitled "Water Heater and Control," filed Aug. 3, 2004.

Weil-McLain, Technical Services Bulletin No. SB201, 2 pages, Nov. 20, 2002.

APPLIANCE CONTROL WITH AUTOMATIC DAMPER DETECTION

This application is a continuation of U.S. patent application Ser. No. 11/276,121, entitled "Applicant Control with Automatic Damper Detection", filed Feb. 15, 2006, which is a continuation-in-part of U.S. patent application Ser. No. 11/306,875, entitled "Building Equipment Component Control With Automatic Feature Detection", filed Jan. 13, 2006, both of which are incorporated herein by reference.

FIELD

The present invention relates generally to fuel fired appliances such as water heaters, furnaces and boilers, and more particularly, to control systems and methods for controlling such fuel fired appliances.

BACKGROUND

Commercial and residential buildings often use fuel fired appliances such as water heaters, furnaces and boilers. In many cases, the fuel fired appliances include a combustion chamber with a flue that is vented to outside of the building (e.g. atmosphere) via a vent pipe or the like. During off-cycle periods, the fuel fired appliances can lose significant heat through the vent pipe or chimney by natural convection and/or conduction. To help reduce these losses, a damper can be installed either at the flue exit or in the vent pipe. Alternatively, two or more dampers may be used, such as a flue damper installed upstream of a draft diverter of the fuel fired appliance, and a vent damper installed downstream of the draft diverter.

In some cases, electric motor controlled flue dampers may be used and controlled by a damper controller or the like. In some cases, the damper(s) may be controlled to open when combustion starts, and close immediately or sometime after combustion stops. This may help minimize the off-cycle heat losses that may occur through the vent pipe or chimney of many fuel fired appliances.

SUMMARY

The following summary of the invention is provided to facilitate an understanding of some of the innovative features unique to the present invention and is not intended to be a full description. A full appreciation of the invention can be gained by taking the entire specification, claims, drawings, and abstract as a whole.

The present invention relates generally to fuel fired appliances, and more particularly, to control systems and methods for operating such fuel fired appliances. The fuel fired appliance may be, for example, a water heater, a furnace, a boiler, or any other fuel fired appliance as desired. The fuel fired appliance may have a combustion chamber with a flue exit that is vented to atmosphere (e.g. outside the building) via a vent pipe or the like.

In some embodiments, a controller is provided that controls the fuel fired appliance, and in some cases, an optional damper. The optional damper may, for example, be a vent or flue damper that, when installed, selectively opens and closes the exhaust path to atmosphere in the vent and/or flue. In some cases, the damper may be installed in, for example, the flue exit of the fuel fired appliance, and/or in the vent pipe, to help minimize the off-cycle heat losses of the fuel fired appliance.

One illustrative method includes the step of detecting if an optional damper is present, and if a damper is present (sometimes for a minimum period of time), determining that the damper is now required. In some cases, it may not be desirable to allow the fuel fired appliance to operate without a damper if a damper was previously installed. As such, the method may further include the steps of: operating the fuel fired appliance if the damper is present and required; operating the fuel fired appliance if the damper is not present and not required; and ceasing to operate the fuel fired appliance normally if the damper is not present but required. The ceasing to operate step may include, for example, preventing or stopping the fuel fired appliance from combusting fuel in the combustion chamber. This may be accomplished by, for example, inhibiting an igniter (if present) from igniting the fuel, preventing a fuel valve that supplies fuel to the combustion chamber from opening, turning off a pilot flame (if present), terminating all power to the fuel fired appliance, and/or any other suitable method of ceasing to operate the fuel fired appliance in a normal manner, as desired.

In some cases, once a damper is detected for at least the minimum period of time, a damper present flag is set in a memory, such as a non-volatile memory. The damper present flag may include a single bit in the memory, or a collection of bits, as desired. When provided in a non-volatile memory, the state of the damper present flag may be saved, even in the event of a power failure. As noted above, the damper present flag, when set, may indicate that a damper is now required in order to operate the fuel fired appliance. The damper present flag may be active low or high, as desired.

During subsequent operation of the fuel fired appliance, the status of the damper present flag may be checked to see if a damper was previously detected and now deemed to be required. If a damper is deemed to be required, the fuel fired appliance may be operated normally if the damper is present, but stopped or otherwise not operated normally if a damper is not currently present. If the status of the damper present flag does not indicate a damper was previously present, and thus the presence of the damper is not required, the fuel fired appliance may be operated normally without a damper present.

In some cases, the damper may be a motorized damper that has one or more conductors fitted to a first connector. The one or more conductors may provide power and/or control signals to the motorized damper. A damper detector may be coupled to a second connector that is adapted to be selectively connected to the first connector of the motorized damper. A controller for the fuel fired appliance may include, or be coupled to, the damper detector. When the damper detector detects that the first connector is connected to the second connector, a damper present flag may be set in a memory, recording that a damper has been detected. In some cases, the damper present flag is not set until the damper detector detects that the first connector is connected to the second connector for a minimum period of time.

The controller may include, or may be coupled to, the damper detector and may be adapted to read the damper present flag from memory. The controller may stop normal operation of the fuel fired appliance if the state of the damper present flag is set and the damper detector detects that the first connector is no longer connected to the second connector. The controller may allow normal operation of the fuel fired appliance if the state of the damper present flag is not set and the damper detector detects that the first connector is not connected to the second connector or, in some cases, has not been connected to the second connector for at least a minimum period of time.

In another illustrative embodiment, the presence of a damper may be detected. If a damper is detected, the fuel fired appliance may be controlled in accordance with a first control algorithm. If a damper is not detected, the fuel fired appliance may be controlled in accordance with a second control algorithm. In some cases, normal operation of the fuel fired appliance may be stopped if a damper is detected as present over a minimum period of time, and then subsequently not detected.

BRIEF DESCRIPTION

The invention may be more completely understood in consideration of the following detailed description of various embodiments of the invention in connection with the accompanying drawings, in which.

Figure 1:
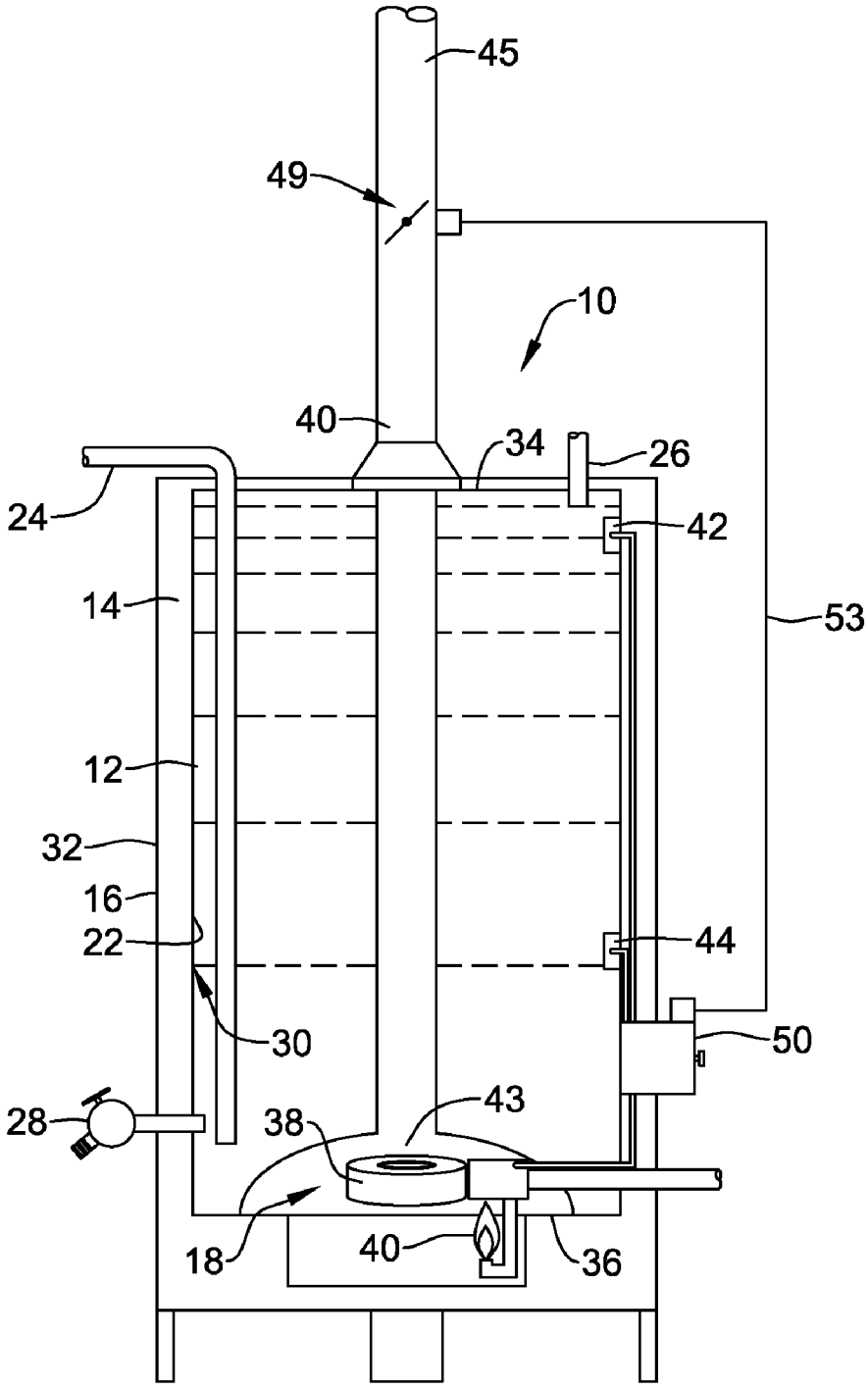
FIG. 1 is cutaway side view of an illustrative fuel fired appliance.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DESCRIPTION

The following description should be read with reference to the drawings wherein like reference numerals indicate like elements throughout the several views. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

The present invention relates generally to fuel fired appliances such as water heaters, furnaces and boilers, and more particularly, to control systems and methods for such fuel fired appliances. Merely for illustrative purposes, and not to be intended as limiting in any manner, the present invention will be discussed with respect to a gas fired water heater, although as indicated above, any suitable gas fired appliance may be used, as desired.

FIG. 1 is cutaway view of an illustrative water heater 10. The illustrative water heater 10 includes a tank 12, an insulating layer 14, an external shell 16, a heater 18, and a controller 50. Tank 12 holds water that is to be heated and may be constructed of steel or other heat conducting material. Illustrative tank 12 has an inner surface 22, an input supply tube or dip tube 24, an output conduit or pipe 26, a drainage valve 28, a rust inhibiting liner 30, and an outer surface 32.

Insulating layer 14 may be located between outer surface 32 of tank 12 and external shell 16. Insulating layer 14 limits or otherwise minimizes the heat loss of the heated water from passing from tank 12 to the outside world. Bonded to the inside of inner surface 22 is rust inhibiting liner 30. In addition, tank 12 may have a sacrificial anode rod (not illustrated) to keep tank 12 from corroding.

Tank 12 also has a top surface 34 and a bottom surface 36. Dip tube 24 and output pipe 26 pass through top surface 34. Output pipe 26 extends through top surface 34 to a second predetermined distance from bottom surface 36. This second predetermined distance may be fairly close to top surface 34. Positioning output pipe 26 close to top surface 34 allows the hotter water, which may be the hottest water in tank 12, to exit upon demand. In operation, when the hot water is demanded, fresh water flows into dip tube 24 to the bottom of tank 12 and pushes or otherwise causes the hotter water at the top of tank 12 to exit through output pipe 26.

Dip tube 24 extends through top surface 34 to a predetermined distance from bottom surface 36. This predetermined distance may be fairly close to bottom surface 36. Positioning the exit of dip tube 24 close to bottom surface 36 allows the fresh, cold or ambient water to enter tank 12 near bottom surface 36. This helps prevent the cold or ambient water from mixing and cooling the hotter water near top surface 34. In practice, dip tube 24 may be located about three quarters of the distance from top surface 34 to bottom surface 36. Because the cooler water entering tank 12 is denser than heated water, the cooler water tends to sink to the bottom of tank 12, where it may be heated.

Heater 18 heats tank 12, which in turn heats any water inside tank 12. In the illustrative embodiment, heater 18 may be one or more gas-fired burners located in a combustion chamber 43. In the exemplary gas-fired water heater 10 shown in FIG. 1, heater 18 may have a gas-flow valve (not shown), a burner 38 and an ignition source 40. The gas-flow valve may be a solenoid-controlled valve, a linear actuated valve, a motor actuated valve, or any other valve capable of supplying gas to burner 38. Ignition source 40 may be a pilot light, a solid-state igniter, an electric heat element, or any other ignition source capable of igniting gas.

The heat output of heater 18 may be controlled by burner orifice size, gas pressure, and/or time. To produce heat in the gas-fired water heater, gas flows into burner 38 in the combustion chamber 43 through the gas-flow valve, where ignition source 40 ignites the gas. The gas will continue to burn until the supply of gas is terminated. The burner 38, which is situated in combustion chamber 43, may be in fluid communication with an exhaust outlet, such as a flue 40. The flue 40 may be coupled to a vent pipe 45 that vents combustion gases exiting from the combustion chamber 43 to atmosphere (e.g. outside of the building).

In some cases, the combustion gases may be vented through the flue 40 and vent pipe 45 through natural convection. Alternatively, a fan or like (not shown) may be provided to help force the combustion gases through the flue 40 and vent pipe 45 to atmosphere. In either case, during off-cycle periods, the water heater 10 can lose heat through the flue 40 and vent pipe 45 to atmosphere by natural convection and conduction. To help reduce these losses, a damper 49 may be installed either at the flue 40 exit or in the vent pipe 45. Alternatively, two or more dampers may be used, such as a flue damper (not shown) installed upstream of a draft diverter (if present) of the water heater, and a vent damper 49 installed downstream of the draft diverter (if present).

In some cases, one or more electric motor controlled dampers may be used. The damper 49 shown in FIG. 1 may be one such electric motor controlled damper. The damper 49 may be controlled by a controller 50 or the like via wiring 53. In some cases, the damper(s) 49 may be controlled to open when combustion in the combustion chamber 43 starts, and close immediately or sometime after combustion stops. This may help minimize the off-cycle heat losses that may occur through natural convection through the vent pipe 45 to atmosphere.

Figure 2:
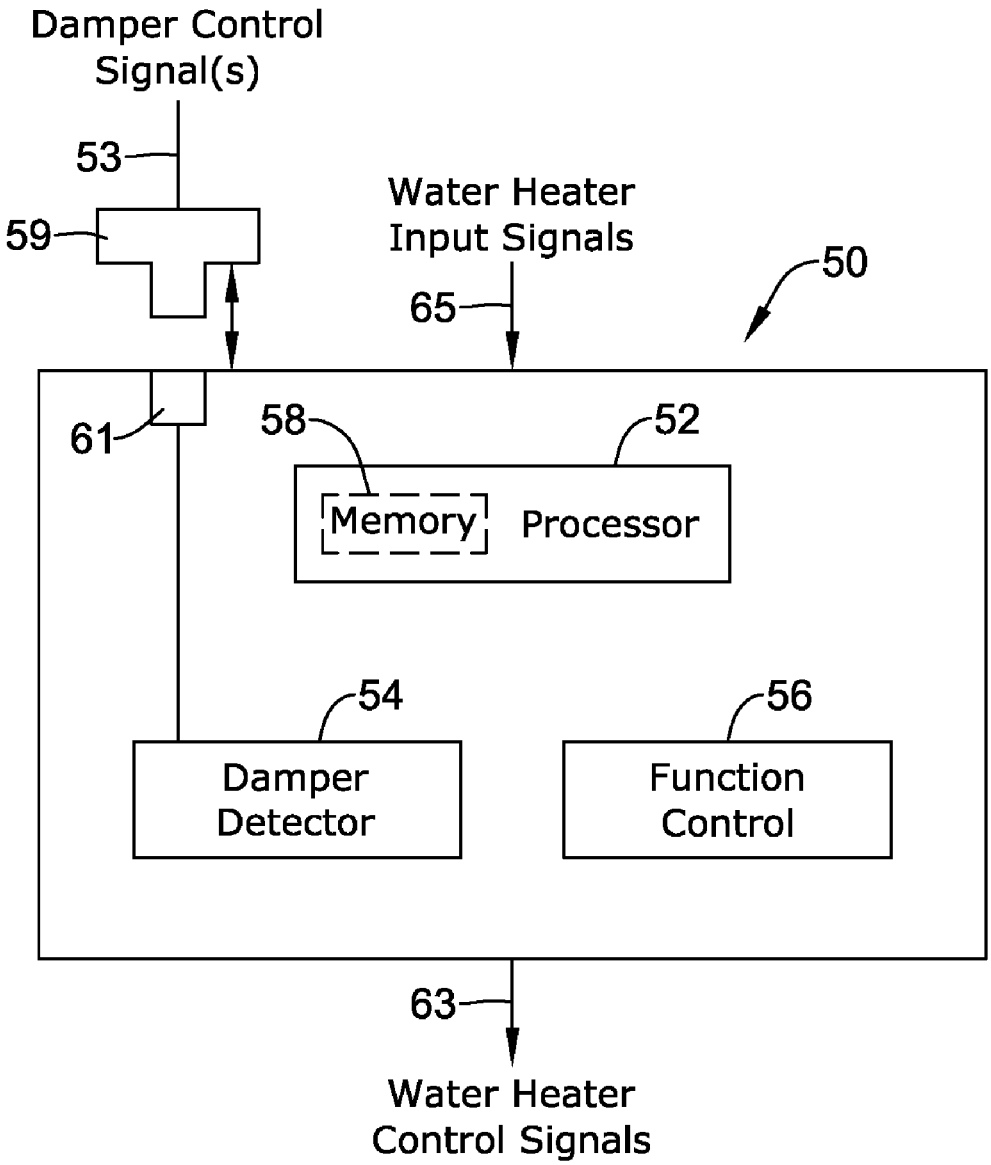
FIG. 2 is a block diagram of an illustrative controller for operating and/or controlling the fuel fired appliance of FIG. 1.

FIG. 2 is a block diagram of an illustrative controller 50 for operating and/or controlling the water heater 10. The illustrative controller 50 includes a damper detector block 54, a function control block 56, a processing block 52, and a memory block 58. The functions of the illustrative controller 50 may be implemented in hardware, software or a combination thereof Under some circumstances, the damper detector block 54, the function control block 56, the processing block 52, and/or the memory block 58 may be integrated on a single device platform, but this is not required.

In the illustrative embodiment, the controller 50 may control the operation of the water heater 10. For example, the controller 50 may control the ignition source or pilot of the water heater, control the opening and closing of a gas valve, control the opening and closing of the optional damper 49, as well as control the operation of other components, depending on the application. The controller 50 may provide one or more water heater control signal signals, as shown at 63, to various components of the water heater 10, and may receive one or more water heater input signals 65 from water heater 10, such as one or more sensor (e.g. temperature sensor) input signals, one or more user interface input signals, etc.

The processing block 52 of the controller 50 may, in some cases, process one or more of the input signals 65, and in response, provide appropriate control signals 63 to the various water heater 10 components, sometimes through the function control block 56. For example, and in some cases, the function control block 56 may be adapted to control the ignition of the burner and/or the ignition source by either allowing ignition of the water heater 10 or not allowing ignition of the water heater 10. It is contemplated that the processing block 52 may include a microprocessor, but this is not required.

The memory block 58 may be included internally to the processing block 52, and/or may be separately provided, as desired. The memory block 58 may store programming, parameter values, historical data, one or more flags such as a damper present flag and/or the like. The memory block 58 may, in some cases, include a non-volatile memory that retains its contents even after power to the memory 58 is interrupted or turned off. The memory block 58 may include, for example, a read-only memory (ROM), electrically erasable programmable read-only memory (EEPROM), flash memory, RAM memory, registers, and/or any other type of memory as desired.

The damper detector block 54 may be used to detect when a damper (such as damper 49 of FIG. 1) is present and connected. The damper detector block 54 may be internal, or coupled to, the processing block 52 of the controller 50, if desired. Under some circumstances, the damper detector block 54 may be a detection circuit, which may provide an electrical signal to the processing block 52 that indicates whether a damper 49 is present and connected.

For example, and as will be discussed in further detail below, the damper detector block 54 may provide a first electrical signal to the processing block 52 when a damper 49 is present and connected to the controller 50, and no signal or a second signal when the damper 49 is not present or not connected to the controller 50. However, this is only illustrative, and it is contemplated that any suitable detection method or signal may be provided by the damper detector block 54, as desired.

One illustrative method of the present invention includes the step of detecting if damper 49 is present using damper detector block 54, and if the damper 49 is present, sometimes for at least a minimum period of time. In some embodiments, the minimum period of time may represent, for example, a predetermined minimum elapse time period, a predetermined minimum number of heating cycles of the water heater 10 (e.g. one, two, three or greater), or any other minimum time period as desired, whether predetermined or not. If the damper detector block 54 detects the presence of the damper 49, sometimes for at least the minimum period of time, the processing block 52 may determine that the damper 49 is required during subsequent operation of the water heater 10.

In some cases, it may not be desirable to allow the water heater 10 to continue to operate without the damper 49 if the damper 49 was previously installed and detected. As such, the method may further include the steps of: operating the water heater 10 if the damper 49 is present and determined to be required; operating the water heater 10 if the damper 49 is not present and not determined to be required; and ceasing to operate the water heater 10 if the damper 49 is not present and determined to be required.

The ceasing to operate step may include, for example, preventing or stopping the water heater 10 from combusting fuel in the combustion chamber 43. This may include manipulating the control signals 63 to, for example, inhibit an igniter (if present) from igniting the fuel, prevent a fuel valve that supplies fuel to the combustion chamber 43 from opening, turn off a pilot flame (if present), terminate all power to the water heater 10, and/or any other suitable method of ceasing to operate the water heater 10 in a normal manner, as desired.

In some cases, once a damper 49 is detected, sometimes for at least a minimum period of time, a damper present flag is set in memory block 58. The damper present flag may include a single bit in the memory block 58, or a collection of bits, as desired. When provided in a non-volatile memory, the state of the damper present flag may be maintained, even in the event of a power failure. As noted above, the damper present flag, when set, may indicate that a damper 49 is now required in order to operate the water heater 10 normally. The damper present flag may be active low or high, as desired.

During subsequent operation of the water heater 10, the processing block 52 may read up the status of the damper present flag from the memory block 58, and check to see if a damper was previously detected and now deemed to be required for future operation of the water heater 10. If a damper 49 is deemed to be required, the water heater 10 may be operated normally if the damper 49 is still present, but stopped or otherwise not operated normally if the damper 49 is not currently present. If the status of the damper present flag does not indicate a damper 49 was previously present and is therefore not now required, the water heater 10 may be operated normally without a damper 49 present.

In some cases, the damper 49 may be a motorized damper that has one or more conductors 53 fitted to a first connector 59. The one or more conductors 53 may convey power and/or control signals to the damper 49. The damper detector block 54 may be coupled to a second connector 61, which is adapted to be selectively connected to the first connector 59 of the damper 49. The processing block 52 may include, or be coupled to, the damper detector block 54. When the damper detector block 54 detects that the first connector 59 is connected to the second connector 61 (sometimes for a minimum period of time, minimum number of heating cycles, etc.), a damper present flag may be set in the memory block 58, recording that the damper 49 has been detected.

The processing block 52 may be adapted to read the damper present flag from memory block 58. This may occur in real time, periodically, at the beginning or end of a heating cycle, and/or at any other time, as desired. The processing block 52 may stop normal operation of the water heater 10 if the state of the damper present flag is set and the damper detector block 54 detects that the first connector 59 is no longer connected to the second connector 61. The processing block 52 may allow normal operation of the water heater 10 if the state of the damper present flag is not set and the damper detector block 54 detects that the first connector 59 is not connected to the second connector 61 or, in some cases, has not been connected to the second connector 61 for at least a minimum elapse period of time, a minimum number of heating cycles, etc.

In some embodiments, if a damper 49 is detected by the damper detector block 54, the controller 50 may control the water heater 10 in accordance with a first control algorithm. The first control algorithm may, for example, be adapted to control the water heater 10 in conjunction with the damper 49. If a damper 49 is not detected by the damper detector block 54, the controller 50 may control the water heater 10 in accordance with a second control algorithm. The second control algorithm may, for example, be adapted to control the water heater 10 without the damper 49. In some cases, the normal operation of the water heater 10 may be stopped if a damper 49 is detected by the damper detector block 54, sometimes for a minimum period of time, and then subsequently not detected.

Figure 3:
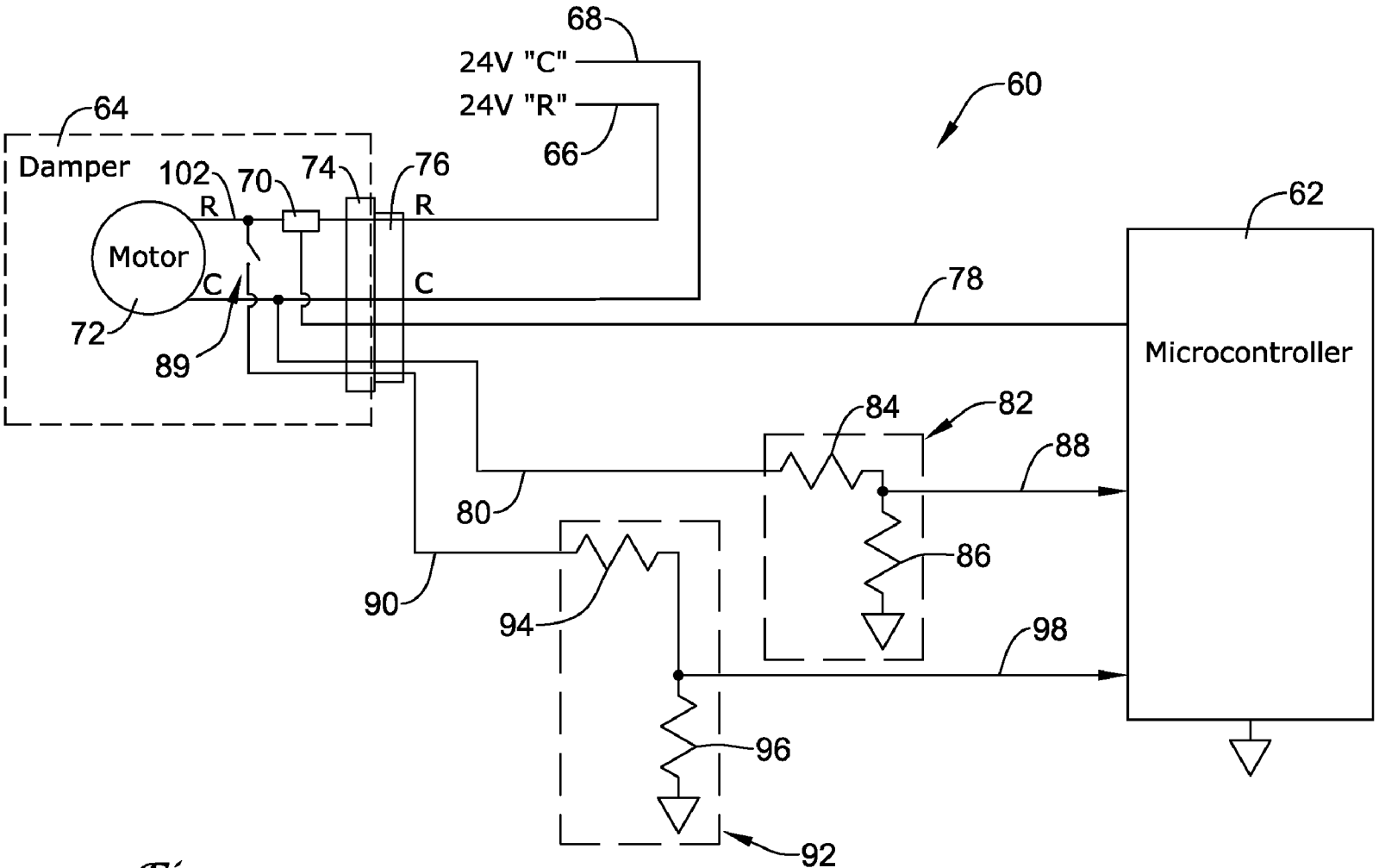
FIG. 3 is a schematic diagram of an illustrative damper detector.

FIG. 3 is a schematic diagram of an illustrative damper detector 60. The illustrative damper detector 60 includes a micro-controller 62, an optional damper 64, a damper relay 70, an end detect switch 89, and two voltage dividers 84 and 92.

In the illustrative embodiment, power is supplied by a 24V AC power signal including an "R" signal 66 and a common "C" signal 68. Power signals R 66 and C 68 may be a 24-volt AC power signal, typically provided by a step down transformer, with the R and C signals 180 degrees out of phase relative to one another. In the illustrative embodiment, the C signal 68 is coupled to a C terminal of a first connector 76, and the R signal 66 is coupled to an R terminal of the first connector 76.

The illustrative damper 64 includes a motor 72 for moving the damper between an open position and a closed position. The motor 72 includes power inputs R and C. In the illustrative embodiment, the R input of the motor 72 is coupled to an R terminal of a second connector 74, through relay 70. The C input of the motor 72 is coupled to a C terminal of a second connector 74. When the damper is provided, the second connector 74 is coupled to the first connector 76, which electrically connects the R and C terminals of the first connector 76 to the R and C terminals of the second connector 74.

During operation, and in the illustrative embodiment, the micro-controller 62 selectively supplies a damper activation signal 78. The damper activation signal 78 is coupled to a damper activation terminal of the first connector 76. The second connector 74 has a corresponding damper activation terminal, which in the illustrative embodiment, is coupled to the control input of relay 70. Thus, when a damper 64 is provided, the micro-controller 62 selectively activates the damper activation signal 78, which selectively closes the relay 70 and supplies the R signal 66 to the R terminal of the motor 72, thereby activating the motor 72 and moving the position of the damper 64.

To detect whether a damper is present and connected, the first connector 76 may have a line 80 that is connected to a first voltage divider 82. The first voltage divider 82 may include a first resistor 84 and a second resistor 86 connected in series. A damper present feedback signal 88 may be taken from the first voltage divider 82 and provided to the micro-controller 62, as shown. When a damper 64 is provided, line 80 of the first connector 76 is connected to the second connector 74. Inside of the second connector 74, or inside the damper 64 assembly itself, line 80 may be connected to the common or "C" terminal of the motor 72. Thus, if the first connector 76 is connected to the second connector 74 (e.g. the damper is present), line 80 will be coupled to the "C" signal 68. However, if the first connector 76 is not connected to the second connector 74 (e.g. the damper is not present), line 80 will be pulled to ground via the first voltage divider 82.

The illustrative damper detector 60 may also be configured to detect when the damper 64 has reached an end position (e.g. fully open position). The damper 64 may include an end detect switch 89, which in the illustrative embodiment, is closed when the damper has reached an end position (e.g. a fully open position) and the motor has finished moving the damper.

In the illustrative embodiment, the first connector 76 may have a line 90 that is connected to a second voltage divider 92. The second voltage divider 92 may include a first resistor 94 and a second resistor 96 connected in series. A damper end detect feedback signal 98 may be taken from the second voltage divider 92 and provided to the micro-controller 62, as shown. When a damper 64 is provided, line 90 of the first connector 76 is connected to the second connector 74. Inside of the second connector 74, or inside the damper 64 assembly itself, line 90 may be connected to one terminal of the end detect switch 89 as shown. The other terminal of the end detect switch may be connected to the "R" terminal of the motor 72. Thus, when a damper 64 is provided, and the first connector 76 is connected to the second connector 74, line 90 will be coupled to the "R" signal 66 when the end detect switch 89 is closed (e.g. the damper has reached a fully open position).

In this configuration, the damper end detect feedback signal 98 will generally follow the damper activation signal 78, but it does not have to if the damper motor 72 is broken. The damper end detect feedback signal 98 will also be delayed relative to the damper activation signal 78 due to the time it takes for the motor 72 to turn the damper to the fully open position. Generally when the damper is fully open (allowing air flow) the end detect switch 89 is closed providing "R" to the voltage divider 92. If a damper 64 is not provided, the first connector 76 is not connected to the second connector 74, and line 90 will be pulled to ground via the second voltage divider.

Figure 4A:
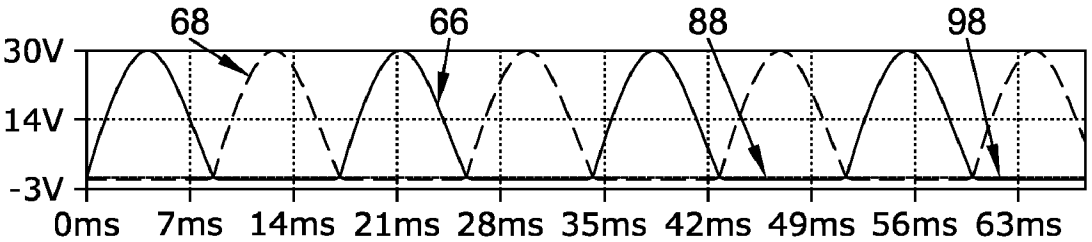
FIGS. 4A-4C show graphs of illustrative feedback signals for the damper detector of FIG. 3 under various operating conditions.
Figure 4B:
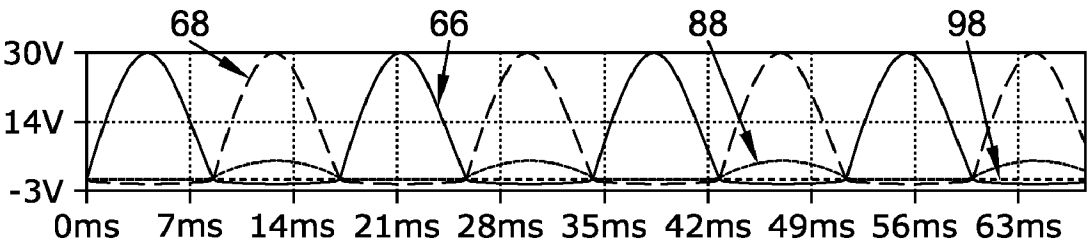
Figure 4C:
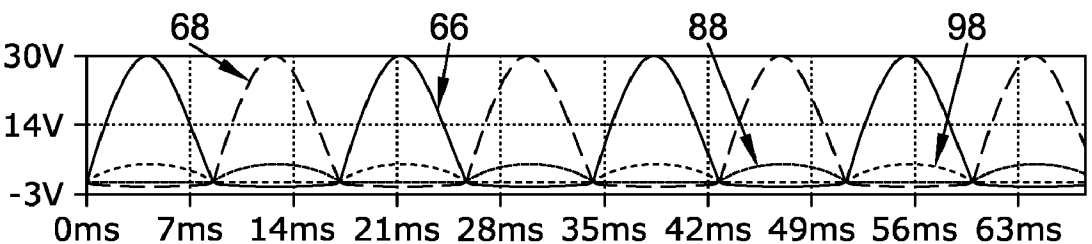

FIG. 4A-4C are graphs showing illustrative feedback signals for the damper detector 60 of FIG. 3 under various conditions. FIG. 4A is an illustrative graph of the R signal 66, the C signal 68, the damper present feedback signal 88, and the damper actuation feedback signal 98, when there is no damper 64 present and the damper actuation relay 70 is open. Referenced from the floating controller ground, the R signal 66 and the C signal 68 appear like half wave rectified 24-volt AC power signal 180 degrees out of phase relative to one another. Because the damper is not present in FIG. 4A, and referring back to FIG. 3, the first connector 76 is not connected to the second connector 74, and thus line 80 is pulled to ground via the first voltage divider 82. Thus, the damper present feedback signal 88 will also be pulled to ground, as shown in FIG. 4A. Likewise, because the first connector 76 is not connected to the second connector 74, line 90 is pulled to ground via the second voltage divider, and the damper actuation feedback signal 98 will also be pulled to ground, as shown.

FIG. 4B is an illustrative graph of the R signal 66, the C signal 68, the damper present feedback signal 88, and the damper actuation feedback signal 98, when a damper 64 is present and connected, and the damper actuation relay 70 is open. Referenced from the floating controller ground, the R signal 66 and the C signal 68 appear like half wave rectified 24-volt AC power signal 180 degrees out of phase relative to one another. Because the damper is present and connected, the first connector 76 is connected to the second connector 74, and line 80 is coupled to the "C" signal 68. As can be seen, the damper present feedback signal 88 follows the "C" signal 68, but at a reduced amplitude that is dictated by the relative values of the first resistor 84 and the second resistor 86 of the first voltage divider 82. Likewise, because the first connector 76 is connected to the second connector 74, line 90 will follow the "R" signal of the motor 72. However, because the damper actuation relay 70 is open in FIG. 4B, the "R" signal 66 is not connected to the "R" signal of the motor 72. Thus, the damper actuation feedback signal 98 will also be pulled to ground through the second voltage divider 92, as shown.

FIG. 4C is an illustrative graph of the R signal 66, the C signal 68, the damper present feedback signal 88, and the damper actuation feedback signal 98, when a damper 64 is present and connected, and the damper actuation relay 70 is closed. Referenced from the floating controller ground, the R signal 66 and the C signal 68 appear like half wave rectified 24-volt AC power signal 180 degrees out of phase relative to one another. Because the damper is present and connected, the first connector 76 is connected to the second connector 74, and line 80 is coupled to the "C" signal 68. Thus, the damper present feedback signal 88 follows the "C" signal 68, but at a reduced amplitude that is dictated by the relative valves of the first resistor 84 and the second resistor 86 of the first voltage divider 82. Likewise, because the first connector 76 is connected to the second connector 74, line 90 will follow the "R" signal of the motor 72. Because the damper actuation relay 70 is closed in FIG. 4C, the "R" signal 66 is connected to the "R" signal of the motor 72. Thus, the damper actuation feedback signal 98 follows the "R" signal 66, but at a reduced amplitude that is dictated by the relative valves of the first resistor 94 and the second resistor 96 of the second voltage divider 92.

The micro-controller 62 may receive the damper present feedback signal 88, and may be programmed to determine if a damper 64 is present. Furthermore, the micro-controller 62 may be programmed to determine if the damper 64 has been present for a minimum period of time, over a minimum number of heating cycles, etc. Likewise, micro-controller 62 may receive the damper actuation feedback signal 98, and may be programmed to determine if the damper 64 is currently being driven. In some cases, the damper present feedback signal 88 and/or the damper actuation feedback signal 98 may be provided to an analog-to-digital (A/D) converter before being provided to the micro-controller 62. In some cases, the micro-controller 62 may itself have A/D converters, but this is not required.

Figure 5:
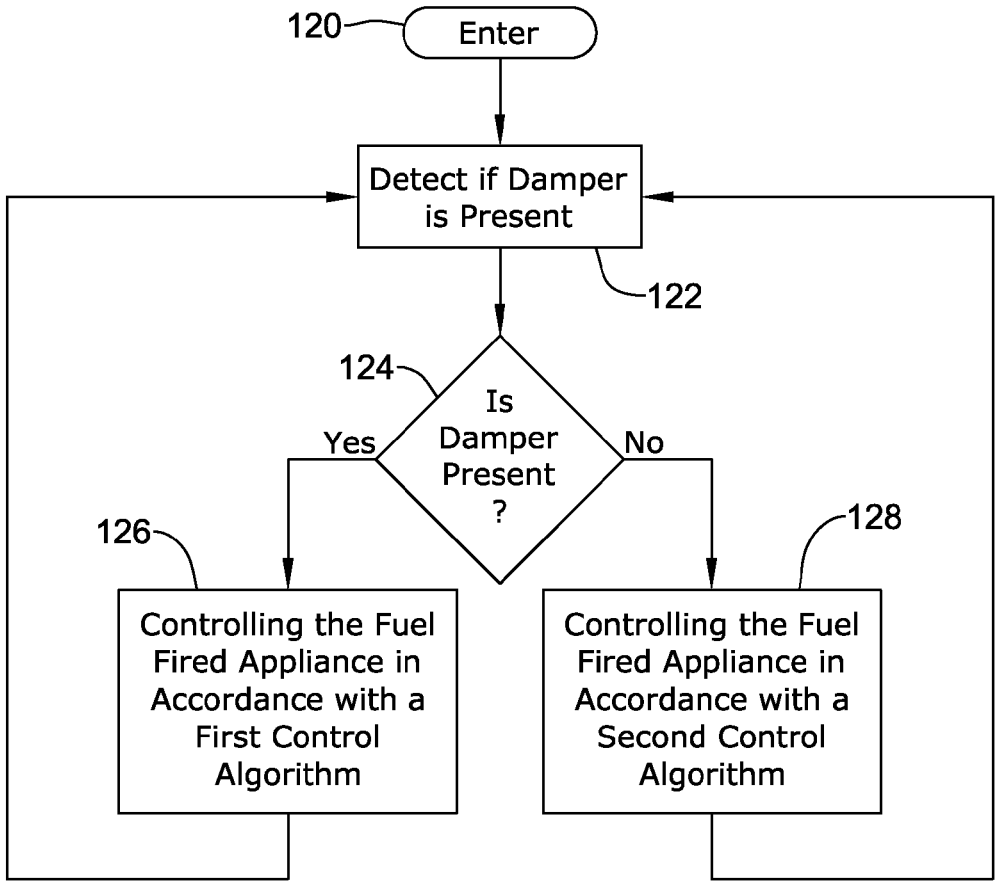
FIG. 5 is a flow diagram of an illustrative method for controlling a fuel fired appliance.

FIG. 5 is a flow diagram of an illustrative method for controlling a fuel fired appliance. The flow diagram is entered at step 120. Step 120 may be entered continuously, periodically, at the beginning or end of a heating cycle, or at any other time, as desired. Control is passed to step 122. Step 122 detects whether a damper is present, and passed control to step 124. If a damper is present, step 124 passes control to step 126, and if a damper is not present, step 124 passes control to step 128. Step 126 controls the fuel fired appliance in accordance with a first control algorithm, and passes control back to step 122. Step 128 controls the fuel fired appliance in accordance with a second control algorithm, and passes control back to step 122. The first control algorithm may, for example, be adapted to control the fuel fired appliance in conjunction with a damper, and the second control algorithm may be adapted to control the fuel fired appliance without a damper.

Figure 6:
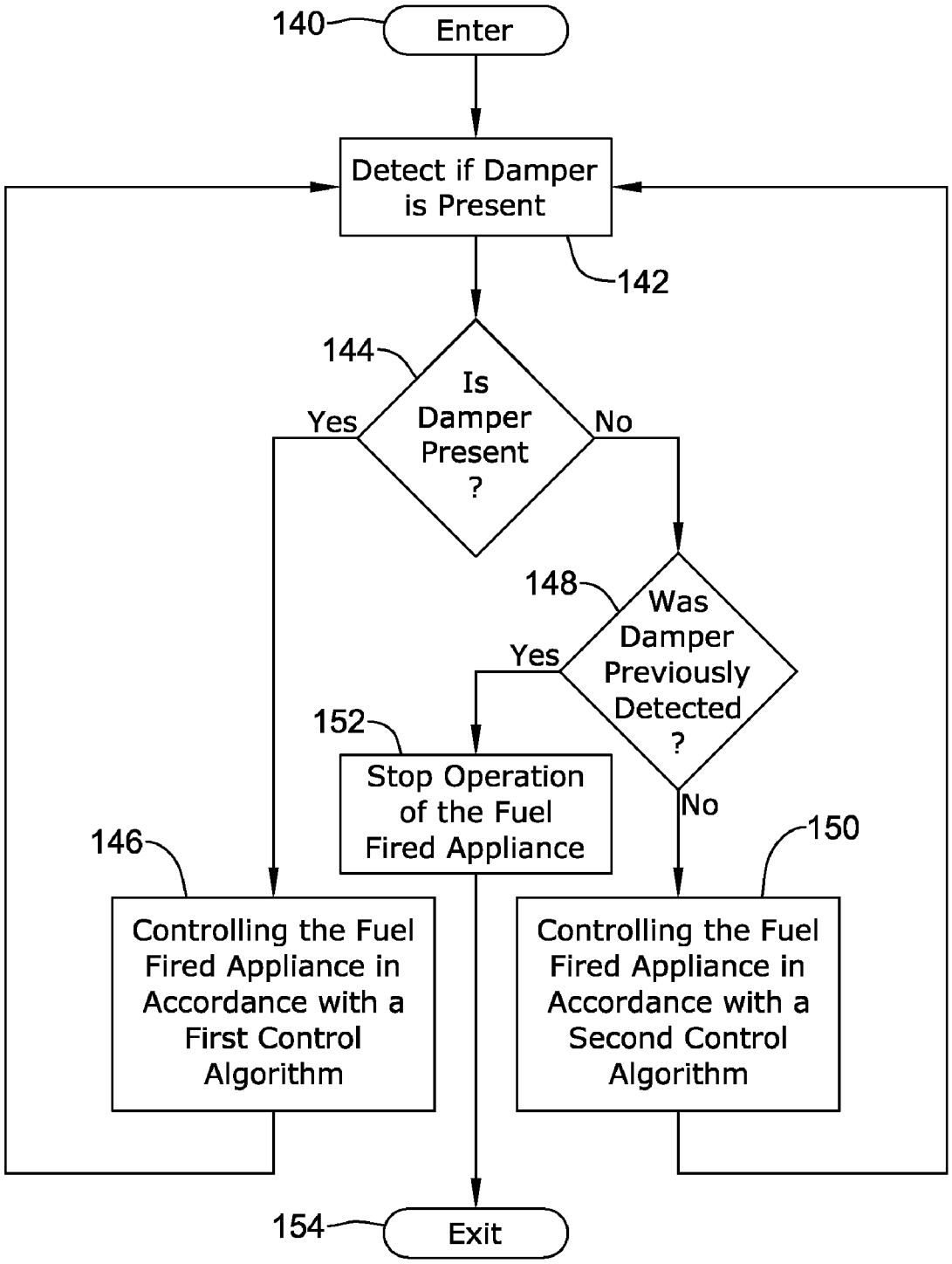
FIG. 6 is a flow diagram of another illustrative method for controlling a fuel fired appliance.

FIG. 6 is a flow diagram of another illustrative method for controlling a fuel fired appliance. The flow diagram is entered at step 140. Step 140 may be entered continuously, periodically, at the beginning or end of a heating cycle, or at any other time, as desired. Control is passed to step 142. Step 142 detects whether a damper is present, and passed control to step 144. If a damper is present, step 144 passes control to step 146, and if a damper is not present, step 144 passes control to step 148.

Step 146 controls the fuel fired appliance in accordance with a first control algorithm, and passes control back to step 142. Step 148 determines if a damper was previously detected. If a damper was not previously detected (in some cases, not previously detected for a sufficiently long period of time), control is passed to step 150. Step 150 controls the fuel fired appliance in accordance with a second control algorithm, and passes control back to step 142. The first control algorithm may, for example, be adapted to control the fuel fired appliance in conjunction with a damper, and the second control algorithm may be adapted to control the fuel fired appliance without a damper.

In some cases, normal operation of the fuel fired appliance may be stopped if a damper is initially detected (sometimes over a minimum period of time or number of heating cycles), and then subsequently not detected. Specifically with respect to the illustrative method of FIG. 6, if step 148 determines that a damper was previously detected (in some cases, detected for a sufficiently long period of time or number of heating cycles), control is passed to step 152. Step 152 stops operation of the fuel fired appliance, and passes control to step 154, wherein the flow diagram is exited.

Figure 7:
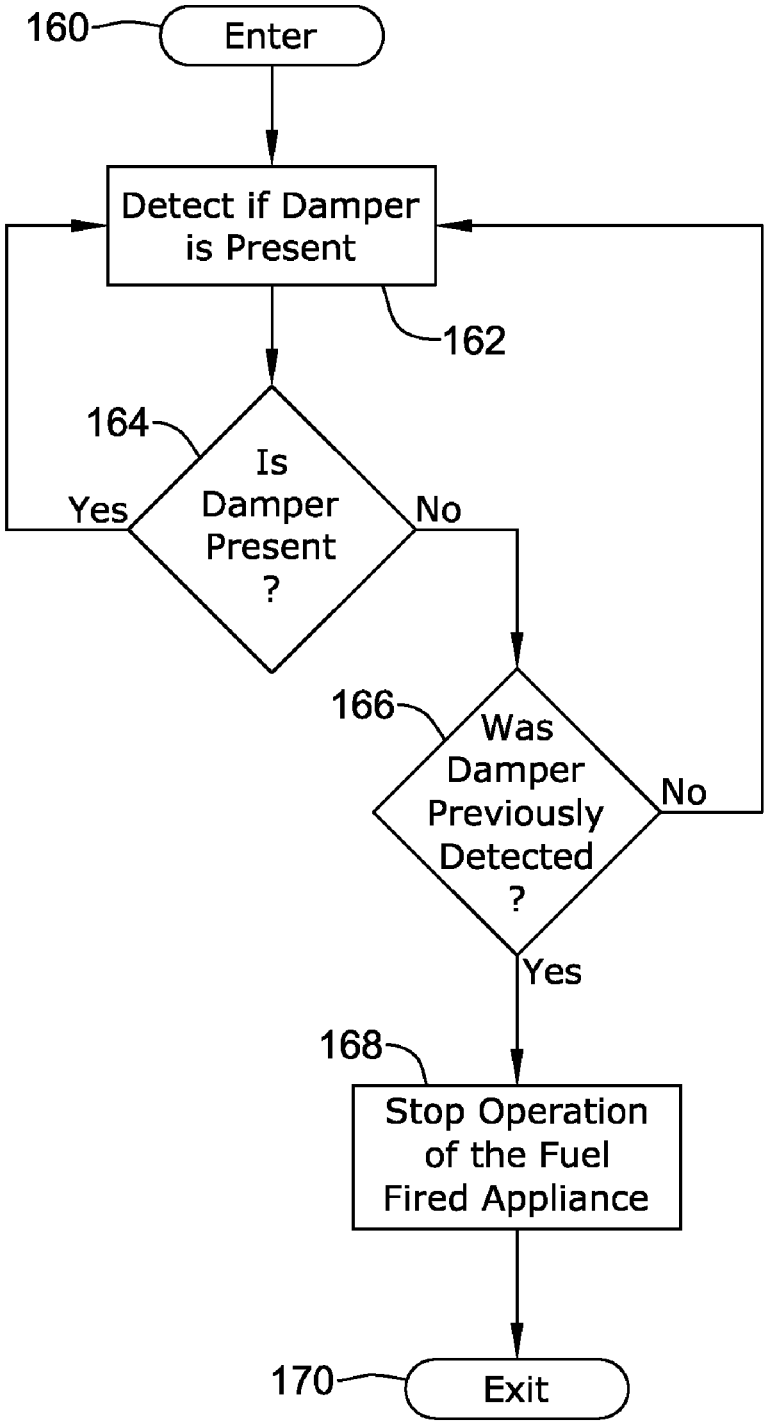
FIG. 7 is a flow diagram of another illustrative method for controlling a fuel fired appliance.

FIG. 7 is a flow diagram of another illustrative method for controlling a fuel fired appliance. The flow diagram is entered at step 160. Step 160 may be entered continuously, periodically, at the beginning or end of a heating cycle, or at any other time, as desired. Control is passed to step 162. Step 162 detects whether a damper is present, and passed control to step 164. If a damper is present, step 164 passes control back to step 162, and if a damper is not present, passes control to step 166.

Step 166 determines if a damper was previously detected. If a damper was not previously detected (in some cases, not detected for a sufficiently long period of time), control is passed back to step 162. If a damper was previously detected (in some cases, detected for a sufficiently long period of time), control is passed to step 168. Step 168 stops operation of the fuel fired appliance, and passes control to step 170, wherein the flow diagram is exited.

Figure 8:
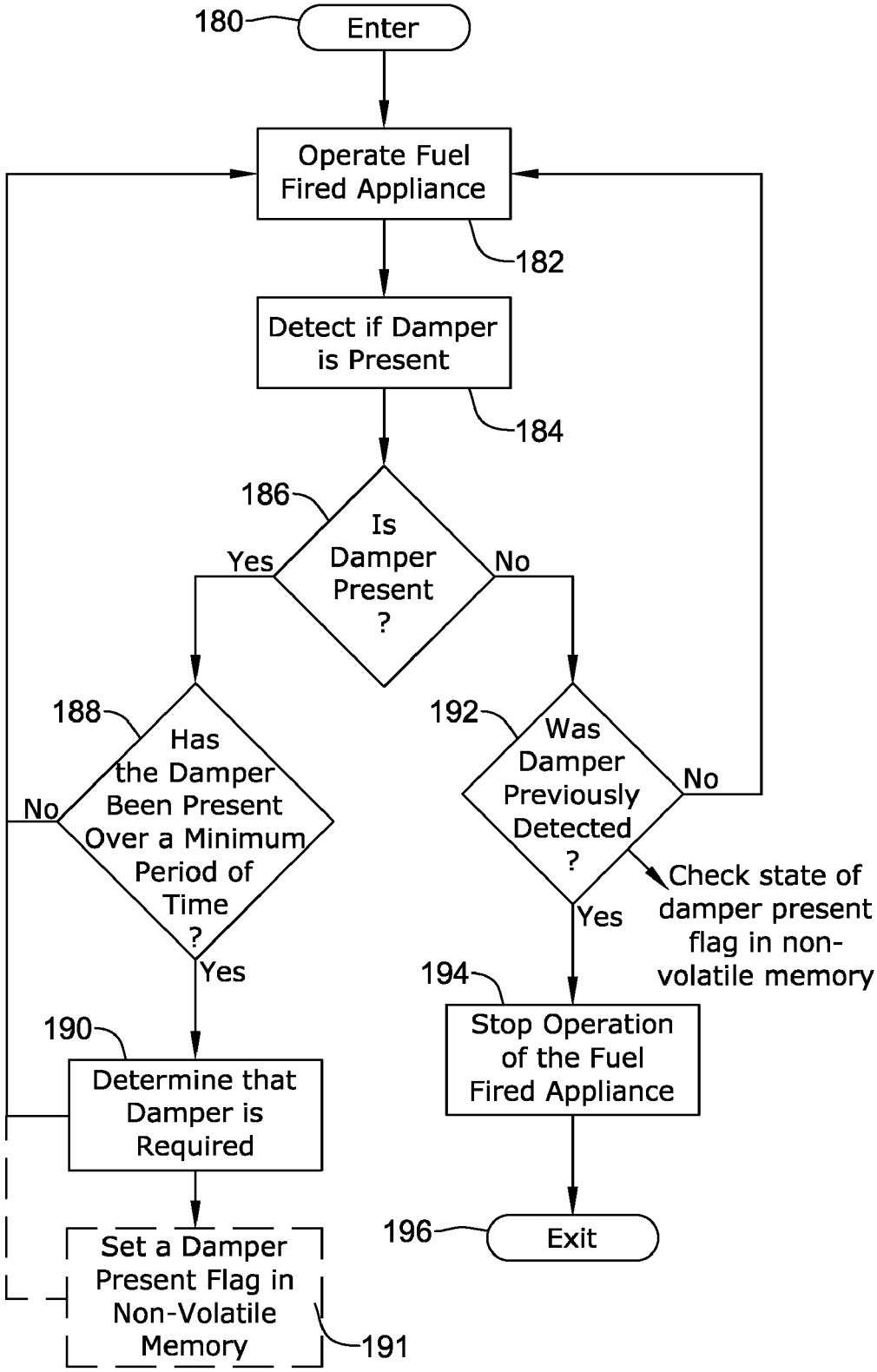
FIG. 8 is a flow diagram of another illustrative method for controlling a fuel fired appliance.

FIG. 8 is a flow diagram of another illustrative method for controlling a fuel fired appliance. The flow diagram is entered at step 180. Step 180 may be entered continuously, periodically, at the beginning or end of a heating cycle, or at any other time, as desired. Control is passed to step 182. Step 182 operates the fuel fired appliance. Control is then passed to step 184.

Step 184 detects if a damper is present, and passed control to step 186. If a damper is present, step 186 passes control back to step 188. Step 188 determines if the damper has been present over a minimum period of time. The minimum period of time may represent a predetermined minimum elapsed time period, a predetermined minimum number of heating cycles of the fuel fired appliance (e.g. one, two, three or greater), or any other minimum time period as desired, whether predetermined or not. If the damper has not been present for a minimum period of time, control is passed back to step 182, wherein the fuel fired appliance is operated. If, however, the damper has been present for a minimum period of time, control is passed to step 190. Step 190 determines that the damper is now required for normal operation of the fuel fired appliance. In some cases, step 190 sets a Damper Present Flag in a non-volatile memory to indicate that the damper is now required for normal operation.

Referring back to step 186, if a damper is not present, control is passed to step 192. Step 192 determines if the presence of a damper is required. In some cases, step 192 may check the status of the Damper Present Flag in non-volatile memory to determine if a damper is now required. If a damper is not required for normal operation of the fuel fired appliance, control is passed back to step 182, wherein the fuel fired appliance is operated. However, if step 192 determines that a damper is required, control is passed to step 194. Step 194 stops normal operation of the fuel fired appliance, and passes control to step 196, wherein the flow diagram is exited.

In some cases, once normal operation of the fuel fired appliance is stopped, a service technician may be required to inspect the fuel fired appliance, replace the controller, reset the Damper Present Flag in non-volatile memory, and/or perform some other action to re-enable the fuel fired appliance.

While a damper has been used as an example optional hardware component of a fuel fired appliance, it is contemplated that the present invention may be used for detecting the presence of other hardware, and controlling the fuel fired appliance accordingly. For example, rather than detecting the presence of a damper, or in addition to detecting the presence of a damper, the present invention may detect the presence of a sensor (e.g. temperature sensor, CO sensor, flame sensor, IR sensor, or other sensor), an ignition source, and/or any other suitable hardware components, depending on the application, and control the fuel fired appliance in accordance with the methods and systems described herein.

Having thus described the preferred embodiments of the present invention, those of skill in the art will readily appreciate that yet other embodiments may be made and used within the scope of the claims hereto attached. Numerous advantages of the invention covered by this document have been set forth in the foregoing description. It will be understood, however, that this disclosure is, in many respect, only illustrative. Changes may be made in details, particularly in matters of shape, size, and arrangement of parts without exceeding the scope of the invention. The invention's scope is, of course, defined in the language in which the appended claims are expressed.

What is claimed is:

1. A gas ignition controller for controlling at least part of the operation of a gas fired appliance, the gas fired appliance having a combustion chamber that is vented to atmosphere via a vent, the gas ignition controller comprising:

a non-volatile memory;

a connector for receiving a plug of an optional damper, wherein the optional damper, when installed, can selectively open and close the vent of the gas fired appliance to atmosphere;

a damper detector in communication with the connector for detecting if the plug of the optional damper is received by the connector; and a controller for controlling at least part of the operation of the gas fired appliance, the controller setting a damper present flag in the non-volatile memory if the damper detector detects that the plug of the optional damper is received by the connector; and the controller further ceasing to operate the gas fired appliance if: (1) the damper detector does not currently detect that the plug of the optional damper is received by the connector; and (2) the damper present flag has been set in the non-volatile memory.

2. The gas ignition controller of claim 1, wherein the controller implements at least part of the damper detector.

3. The gas ignition controller of claim 1, wherein the controller is implemented separate from the damper detector.

4. The gas ignition controller of claim 3, wherein the controller includes a microcontroller.

5. The gas ignition controller of claim 4, wherein the microcontroller includes the non-volatile memory.

6. The gas ignition controller of claim 1, wherein the damper detector includes:

a first resistor having a first end and a second end;

a second resistor having a first end and a second end; and wherein the first end of the first resistor is electrically connected to the second end of the second resistor, and wherein the second end of the first resistor is electrically connected to ground.

7. The gas ignition controller of claim 1, wherein the damper detector includes:

a first resistor;

a second resistor electrically coupled to the first resistor;

wherein one end of the second resistor is coupled to a pin of the connector.

8. The gas ignition controller of claim 1, further including a voltage divider coupled to a pin of the connector, wherein an output of the voltage divider provides a damper end switch detect signal.

9. The gas ignition controller of claim 8, wherein the damper end switch detect signal is provided to the controller.

10. The gas ignition controller of claim 1, wherein power is provided from the gas ignition controller to the optional damper via the connector when the plug of the optional damper is received by the connector.

11. A gas ignition controller for controlling at least part of the operation of a gas fired appliance, the gas fired appliance having a combustion chamber that is vented to atmosphere via a vent, the gas ignition controller comprising:

a non-volatile memory;

a connector for receiving a plug of an optional damper, wherein the optional damper, when installed, can selectively open and close the vent of the gas fired appliance to atmosphere;

a microcontroller for controlling at least part of the operation of the gas fired appliance;

a damper detect circuit for providing a damper detect signal to the microcontroller, the damper detect circuit is in communication with the connector and configured to activate the damper detect signal if the plug of the optional damper is received by the connector, the damper detect circuit including:

a first resistor having a first end and a second end, wherein the second end of the first resistor is connected to ground;

a second resistor having a first end and a second end;

wherein the first end of the first resistor is coupled to the second end of the second resistor at a node, wherein the node includes a signal that indicates if the plug of the optional damper is received by the connector or not;

the microcontroller receiving the damper detect signal from the damper detect circuit and setting a damper present flag in the non-volatile memory if the damper detect signal is activated; and the microcontroller ceasing operation of the gas fired appliance if: (1) the damper detect circuit is not currently activating the damper detect signal; and (2) the damper present flag has been set in the non-volatile memory.

12. The gas ignition controller of claim 11, further including a voltage divider in communication with the connector, wherein an output of the voltage divider provides a damper end switch detect signal to the microcontroller.

13. The gas ignition controller of claim 11, wherein the microcontroller includes the non-volatile memory.

14. The gas ignition controller of claim 11, wherein power is provided from the gas ignition controller to the optional damper via the connector when the plug of the optional damper is received by the connector.

15. The gas ignition controller of claim 11, wherein the signal at the node is the same as the damper detect signal.

16. A method of operating a fuel fired appliance, the fuel fired appliance having a combustion chamber that is vented to atmosphere via a vent, the fuel fired appliance further having a controller for controlling the fuel fired appliance as well as an optional damper that, when installed, can selectively open and close the vent to atmosphere, the method comprising:

detecting if a damper is present;

controlling the fuel fired appliance in accordance with a first control algorithm that includes controlling the damper, if the detecting step detects that the damper is present; and controlling the fuel fired appliance in accordance with a second control algorithm that does not include controlling the damper, if the detecting step detects that the damper is not present.

17. The method of claim 16, further comprising not allowing the fuel fired appliance to operate without a damper present if a damper was previously detected as present.

18. The method of claim 16 further comprising ceasing to operate the fuel fired appliance without a damper present if a damper was previously detected as being present.

19. The method of claim 16 further comprising ceasing to operate the fuel fired appliance if the detecting step detected that the damper was previously present, and subsequently detects that the damper is no longer present.

20. The method of claim 19 further comprising:

setting a damper present flag in a non-volatile memory if the detecting step detects that the damper is present; and if the detecting step detects that the damper is not present, checking to see if the damper present flag has been previously set, and if the damper present flag has been previously set, ceasing to operate the fuel fired appliance.

* * * * *